US005676058A

United States Patent [19]

Ireton

[11] Patent Number: 5,676,058

[45] Date of Patent: Oct. 14, 1997

[54] PRINTING PLATE MOUNTING SYSTEM AND METHOD EMPLOYING THE SAME

[76] Inventor: Robert E. Ireton, 7865 John Elwood Dr., Centerville, Ohio 45459

[21] Appl. No.: 656,971

[22] Filed: Jun. 6, 1996

[51] Int. Cl.[6] ..... B41M 1/12

[52] U.S. Cl. ..... 101/486; 101/383; 101/401.1; 101/415.1; 101/DIG. 36

[58] Field of Search ..... 101/485, 486, 101/378, 382.1, 383, DIG. 36, 401.1, 415.1

[56] References Cited

U.S. PATENT DOCUMENTS

| | | | |
|---|---|---|---|
| 3,605,622 | 9/1971 | Zarif | 101/DIG. 36 |
| 4,611,539 | 9/1986 | Ireton . | |
| 5,065,677 | 11/1991 | Leader, Jr. | 101/DIG. 36 |
| 5,211,112 | 5/1993 | Tsushima et al. | 101/415.1 |
| 5,487,340 | 1/1996 | Kanai | 101/486 |
| 5,560,297 | 10/1996 | Ford | 101/486 |
| 5,596,926 | 1/1997 | Zimmer | 101/DIG. 36 |

*Primary Examiner*—Eugene H. Eickholt
*Attorney, Agent, or Firm*—R. William Graham

[57] ABSTRACT

A system for mounting a flexographic printing plate having a registration mark includes a printing plate support surface having a transparent portion formed therein, a plate cylinder, means operably connected to the plate cylinder for positioning the plate cylinder toward the printing plate support surface in a manner to establish a uniform contact line along one side of the printing plate when positioned on the printing plate support surface, a camera operably disposed adjacent another side of the transparent portion for taking a picture of the registration mark of the printing plate when the same is positioned over one side of the transparent portion and a monitor operably connected to the camera having means for viewing the registration mark and position thereof with respect to the camera in another embodiment which includes a pressure roller and method employing the same.

12 Claims, 12 Drawing Sheets

PRINTING PLATE MOUNTING SYSTEM AND METHOD EMPLOYING THE SAME

BACKGROUND OF THE INVENTION

1. Field of the Invention

The present invention relates to a printing plate mounting system and method for the same. More specifically, the invention relates to a printing plate mounting system using cameras and plate mounting aid and methods employing the same.

2. Related Art

There exist a number of techniques for mounting a flexographic printing plate onto a plate cylinder. Techniques commonly employ a method of aligning a pair of microdots formed on the plate with a central axis of the plate cylinder to place the plate in register, wherein the plate cylinder is placed into a printing system such that the plates are generally in register to a web's printing run direction.

The industry trend has been to use a pair of cameras which are positioned in parallel over a printing plate mounting surface. Each camera is operatively connected to a split screen monitor to display the position of the microdots. The microdots, and in turn the printing plate, are manually manipulated on the printing plate mounting surface as well as the cameras to bring the microdots into a center of the screen to indicate a registering of the plate on the surface. Then, a sticky-back cylinder is brought in contact with the printing plate, lifted and hand rolled onto the cylinder.

These techniques require a relatively high degree of human intervention in judgment of alignment and positioning. Additionally with such systems, the mounter's hands and/or the sticky-back cylinder is necessarily interposed between the cameras and microdots and consequently interfere with viewing the microdots. Accordingly, this increases possible errors in alignment of printing plates which can occur in displacing the microdots slight amounts each time a centering of the microdots is accomplished. These errors are considerably noticed in printing multicolor jobs wherein respective color printing plates are positioned on respective plate rollers so that when the web passes from one roller to the next, each color will be accordingly applied and misalignments result in miscoloring of the end product. Likewise, these errors are noticeable in some black and white applications.

There is a need to improve printing plate mounting systems. There is also a need to increase the accuracy in which the alignment of printing plates is accomplished and accordingly reduce the errors which are introduced during the registering process.

BRIEF SUMMARY OF THE INVENTION

An object is to improve printing plate mounting systems.

Another object is to improve the system and method for mounting flexographic printing plates.

Accordingly, the present invention is directed to a system for mounting a flexographic printing plate having a registration mark, including a printing plate support surface having a transparent portion formed therein, a plate cylinder, means operably connected to the cylinder for positioning the cylinder toward the printing plate support surface in a manner to establish a uniform contact line along one side of the printing plate when positioned with its registration marks over transparent portion, a camera operably disposed adjacent another side of the transparent portion for taking a picture of the registration mark of the printing plate and a monitor operably connected to the camera having means for viewing the registration mark and position thereof with respect to the camera.

A method for mounting a flexographic printing plate which has a registration mark thereon includes the steps of orienting the printing plate onto a printing plate support surface having a transparent portion in the surface thereof such that the registration mark is positioned over one side of the transparent portion, orienting camera means adjacent another side of the transparent portion for viewing the registration mark when positioned over the transparent portion, manipulating at least one of the printing plate and the camera means such that the registration mark is substantially centered within the view afforded the camera means, contacting a plate cylinder to a first surface of the printing plate along a uniform contact line, and adheringly applying to the printing plate to said cylinder. The method may further include contacting a rotatable pressure roller to a second surface of the printing plate along the contact line such that the printing plate is frictionally disposed between the plate cylinder and the pressure roller to aid in applying the printing plate to the plate cylinder.

Another aspect of the invention includes in a printing plate mounting system for a flexographic printing plate, a plate cylinder, a printing plate support surface, means operably connected to the cylinder for positioning the cylinder toward the printing plate support surface in a manner to establish a uniform contact line on one side of the printing plate when positioned on the printing plate support surface, a pressure roller and means operably connected to the pressure roller for positioning the pressure roller toward the plate cylinder in a manner to dispose the pressure roller on another side of the printing plate along the contact uniform line such that the printing plate is frictionally disposed between the plate cylinder and the pressure roller.

Another method for mounting a flexographic printing plate comprises the steps of orienting the printing plate onto a printing plate support surface, contacting a rotatable plate cylinder to a first surface of the printing plate along a uniform contact line, moving the plate cylinder away from the printing plate support surface with the printing plate fixed in relative position thereto along the contact line, contacting a rotatable pressure roller to a second surface of the printing plate along the contact line such that the printing plate is frictionally disposed between the plate cylinder and pressure roller, and rotating one of the plate cylinder and pressure roller in an adheringly manner to cause the printing plate to generally uniformly adhere to the plate cylinder.

Other objects and advantages will be more apparent from reading the following drawings and description hereto.

DETAILED DESCRIPTION OF THE PREFERRED EMBODIMENTS

Figure 1:
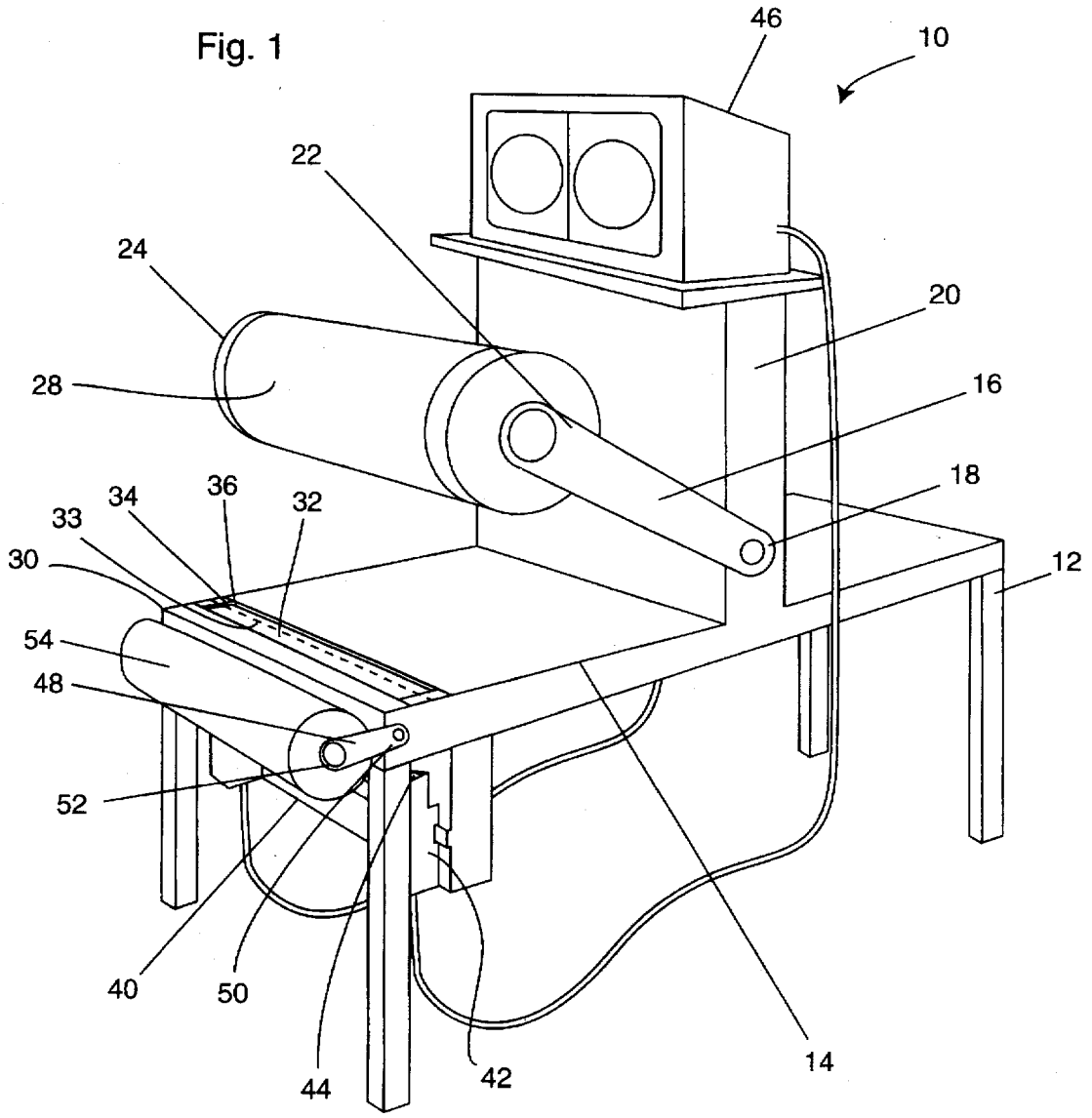
FIG. 1 is a perspective view showing a printing plate mounting system of the present invention.

Referring now to the drawings, a printing plate mounting system is generally referred to by the numeral 10. The mounting device 10 shown in FIGS. 1–14, includes legs 12, a printing plate support surface 14 connected to the legs 12, a pair of arms 16 removably hingedly connected at one end 18 to an extension 20 of the printing plate support surface 14. Rotatably removably connected at the other end 22 of the arms 16 is a plate cylinder 24 onto which a flexographic printing plate 26 (as seen in FIG. 3, for example) having a microdot thereon is to be mounted. Commonly, the plate cylinder 24 will include a sticky back 28 for affixing the printing plate 26 to the plate cylinder, but other means of accomplishing this will be apparent to those skilled in the art.

One end 30 of the printing plate support surface 14 includes a transparent plate 32 which is disposed in a manner such that as the cylinder 24 is positioned adjacent the printing plate support surface 14, a central axis of the plate cylinder 24 will extend generally along a central axis 33 of the transparent plate 32. The central axis 33 is preferably marked in a visible manner on the transparent plant 32 to aid in the registration of the printing plate 26 as later discussed herein. The transparent plate 32 is seated between recessed surfaces 34 and 36 of the printing plate support surface 14.

Figure 2:
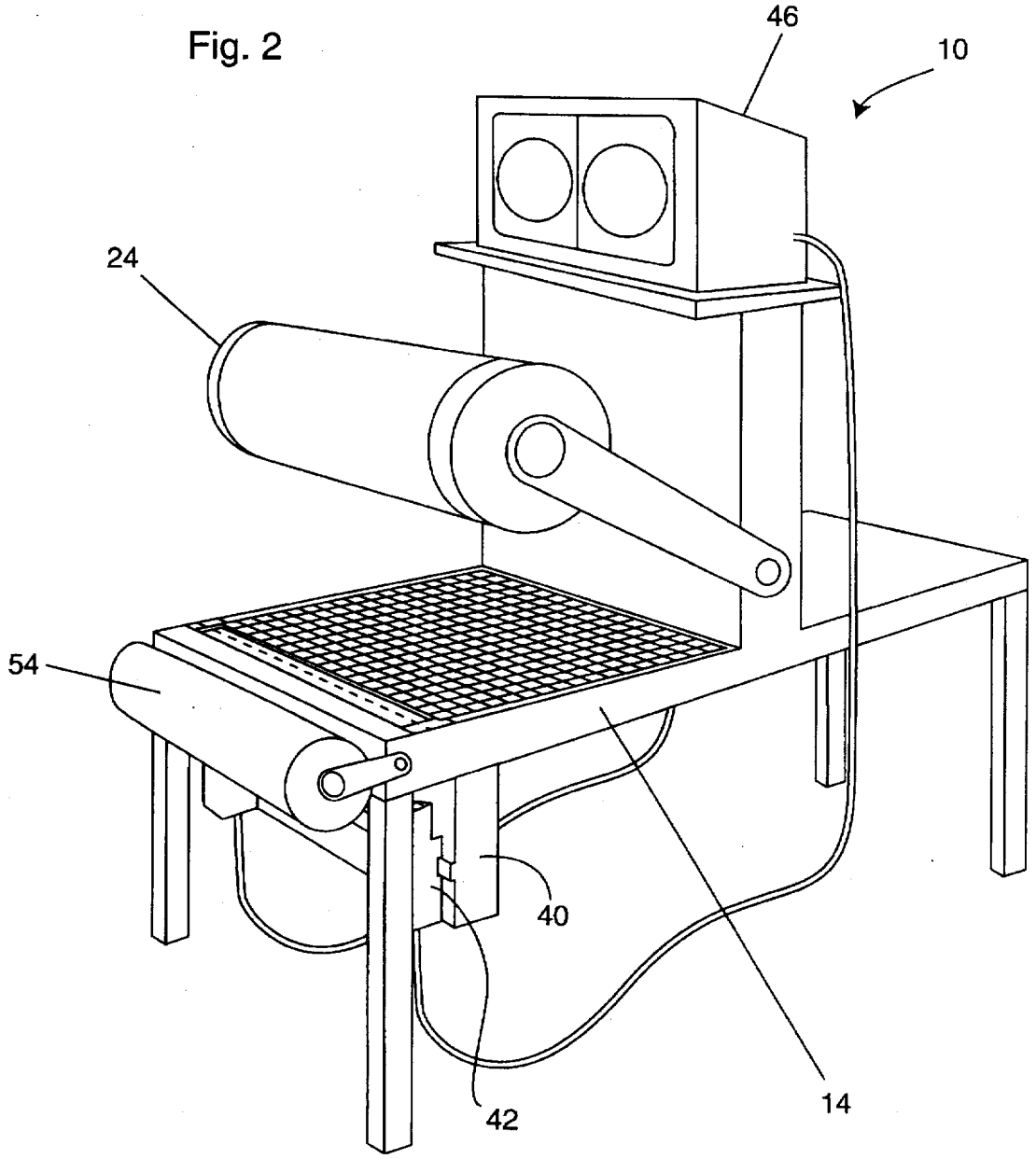
FIG. 2 is a perspective view showing a printing plate mounting system of the present invention having a registration grid on a printing plate support surface.
Figure 3:
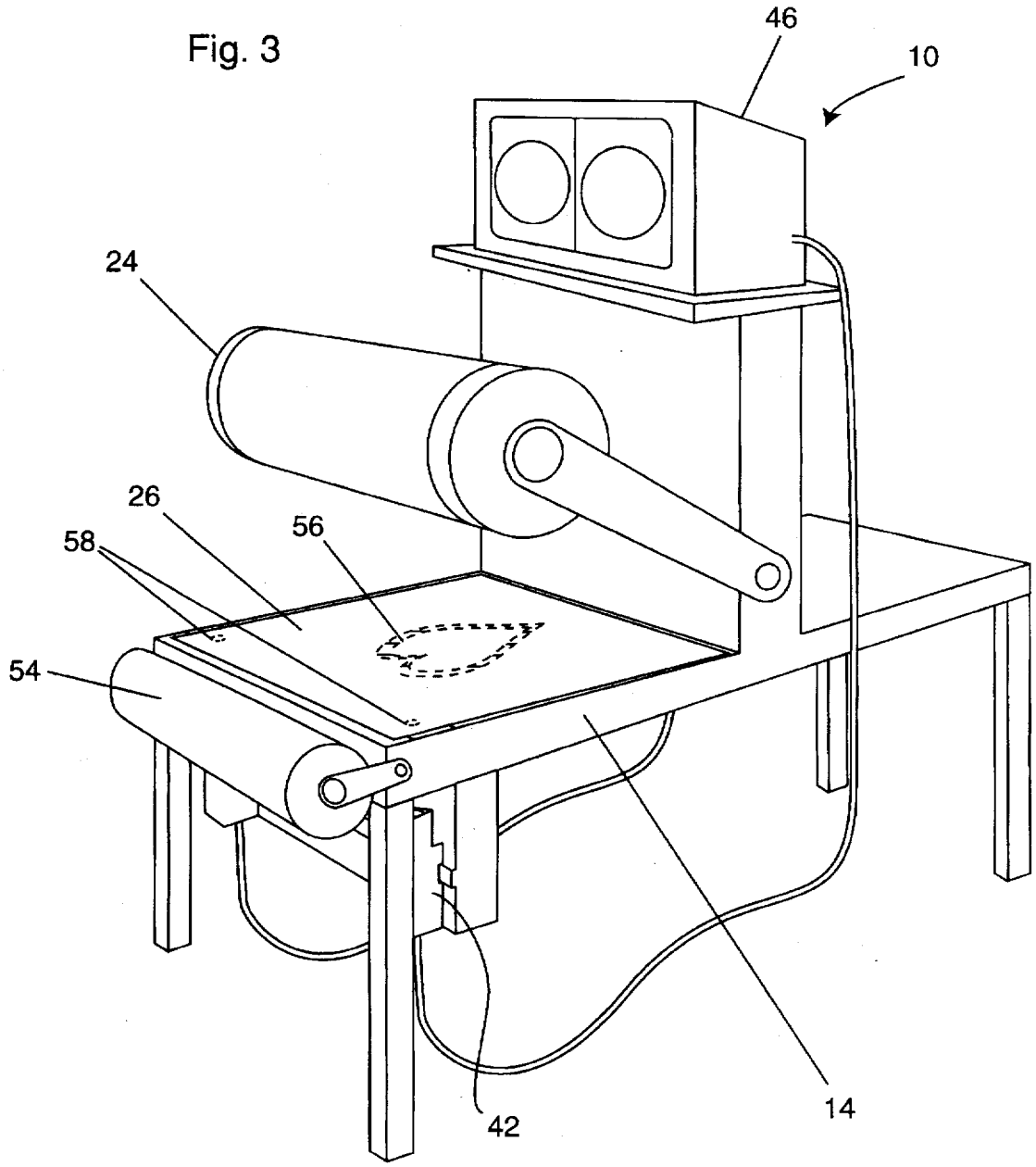
FIG. 3 is a perspective view showing a printing plate mounting system of the present invention having a flexographic printing plate thereon.

As shown in FIG. 2, the printing plate support surface may include a grid which is useful in registering the printing plate. The grid may be either integrally formed onto the printing plate support surface 14 or as an overlay to be laid over the printing plate support surface.

Extending beneath and movably connected to the printing plate support surface 14 adjacent the transparent plate 32 is a track 40. Reciprocally slidably lockably connected to the track 40 and actuatably positionable are cameras 42 which have their lens 44 predisposed to focus on the central axis 33 of the transparent plate 32 as each moves back and forth along the track 40. The cameras 42 are operably connected to a split screen monitor 46 which is, in this case, disposed on the extension 20 for ease of viewing while working, but may be disposed at any desired location. The track 40, cameras 42 and monitor screen 46 are of the type known to the art. The cameras 42 and monitor screen 46 are, for example, equipped to show 30× magnification and have a centering circle to show viewed, i.e., a registration mark or microdot.

A pair of arms 48 are pivotally mounted at one end 50 to the end 30. At the arms 48 other end 52 is a rotatably mounted pressure roller 54.

The plate 26 may be formed form, for example, a photopolymer of the type from: Dupont Cyrel, B.A.S.F./NAPP Nylo-flex, Hercules pourable polymers, W. R. Grace Flexlite or Supratech Flexceed; or a rubber of the type from: Uniroyal, Good-Year, B. F. Goodrich, Mosstype or Graphic-Arts Rubber. Such materials can typically be obtained in sizes up to 60"×120".

The flexographic printing plate 26 is produced in a conventional manner known to the art and as described in Flexography—Principles and Practices—Published by Flexographic Technical Association—Library of Congress Catalog Card No. 80-69506, Chapter VI, Engraving and Printing Pates, pages 149–183, incorporated herein by reference. For the materials listed above, the photopolymer is exposed to an ultraviolet light on one side for a predetermined period to harden and cure the photopolymer to a predetermined depth of a relief to be formed on the other side for the etching process. The other side of the plate is then covered with a photographic negative and exposed to the ultraviolet right to harden the printing surface through to the pre-hardened depth. The photographic negative is removed from the printing plate and the printing plate is washed with a polymer solvent to remove the unhardened material thus providing a printing surface 56, as seen best in FIGS. 15 and 16. The plate 26 may be more fully hardened if desired.

Figure 15:
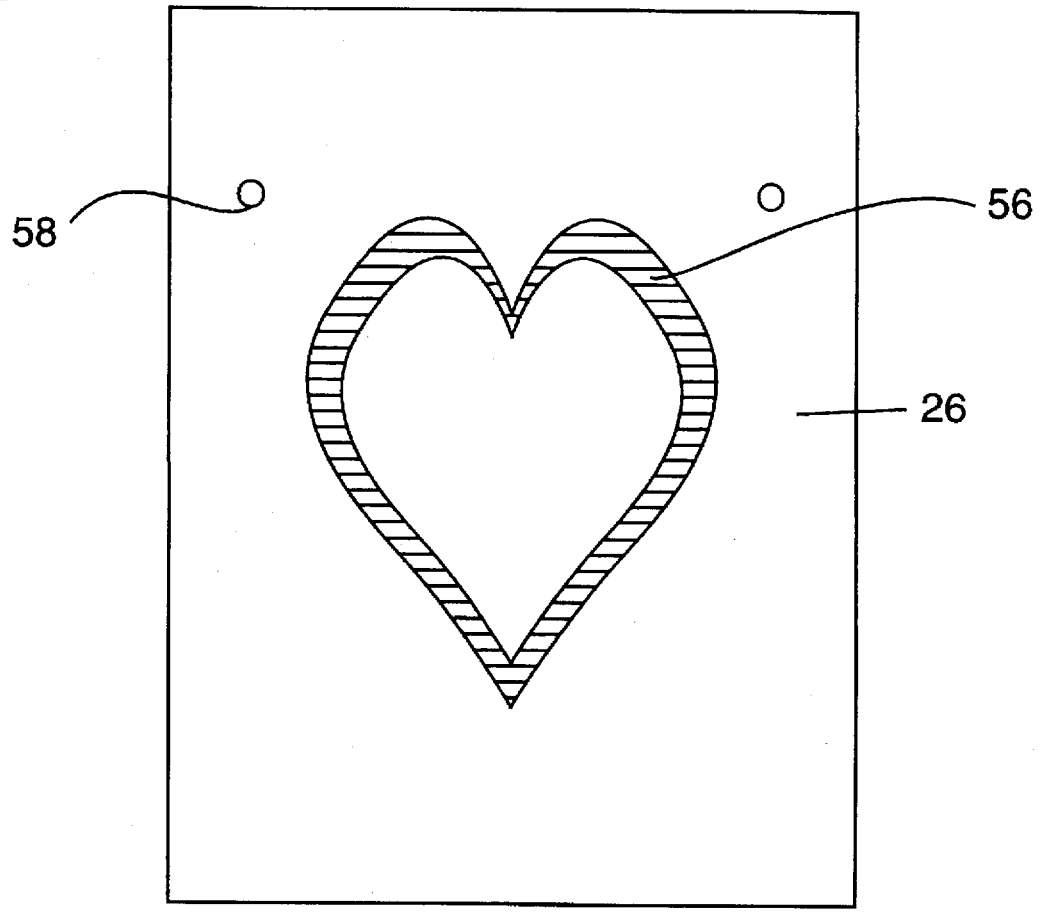
FIG. 15 is a plan view of a flexographic printing plate for use with the present invention.
Figure 16:
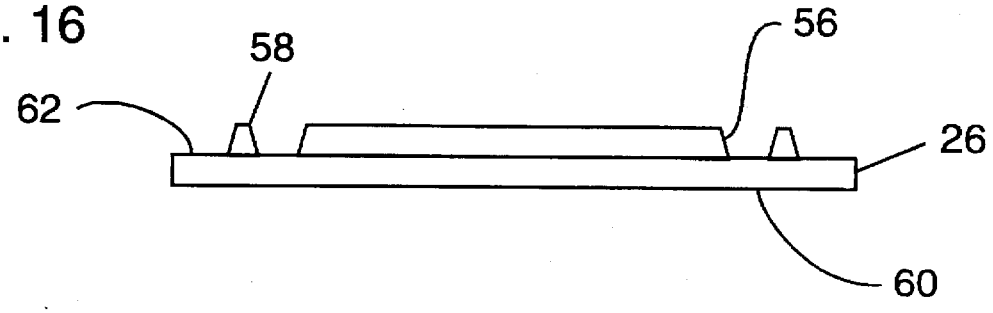
FIG. 16 is an end view of the flexographic printing plate in FIG. 15.

In recent years, the photographic negative has been generated using the aid of a computer. This has enabled the formation highly accurate graphic artwork. Particularly, the artwork can be easily positioned at any desired x and y coordinates. This positioning ability precipitated the invention of microdots 58, as shown in FIGS. 15 and 16, for example, a pair of small dots formed in the plate 26, which have been widely used in the industry as a registering aid, i.e., a registration mark is created useful in orienting the plate. The microdots are uniformly formed along an x and/or y coordinate ( via creating a small transparent circle in the photographic negative adjacent the art design) in the plate 26 and have been used principally in the registering process by attempting to align these microdots with a common x/y coordinate of another surface (e.g., the printing plate support surface) to permit the plate 26 to be mounted in register to the plate cylinder 24. Other registering configurations are contemplated in the present invention and are accordingly to be included within the scope of the present invention.

Figure 4:
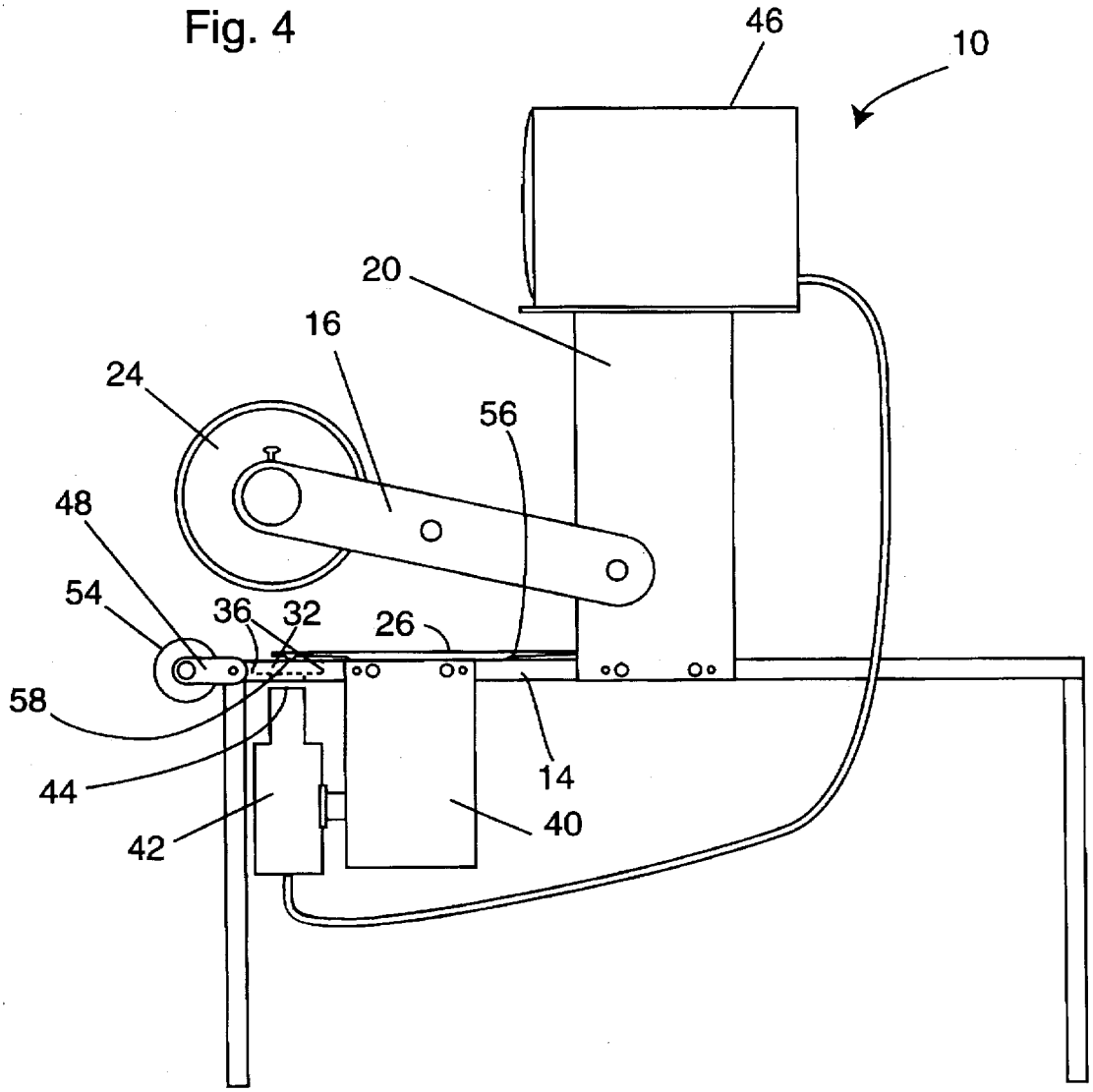
FIG. 4 is a side view showing a printing plate mounting system of the present invention having a flexographic printing plate thereon.
Figure 5:
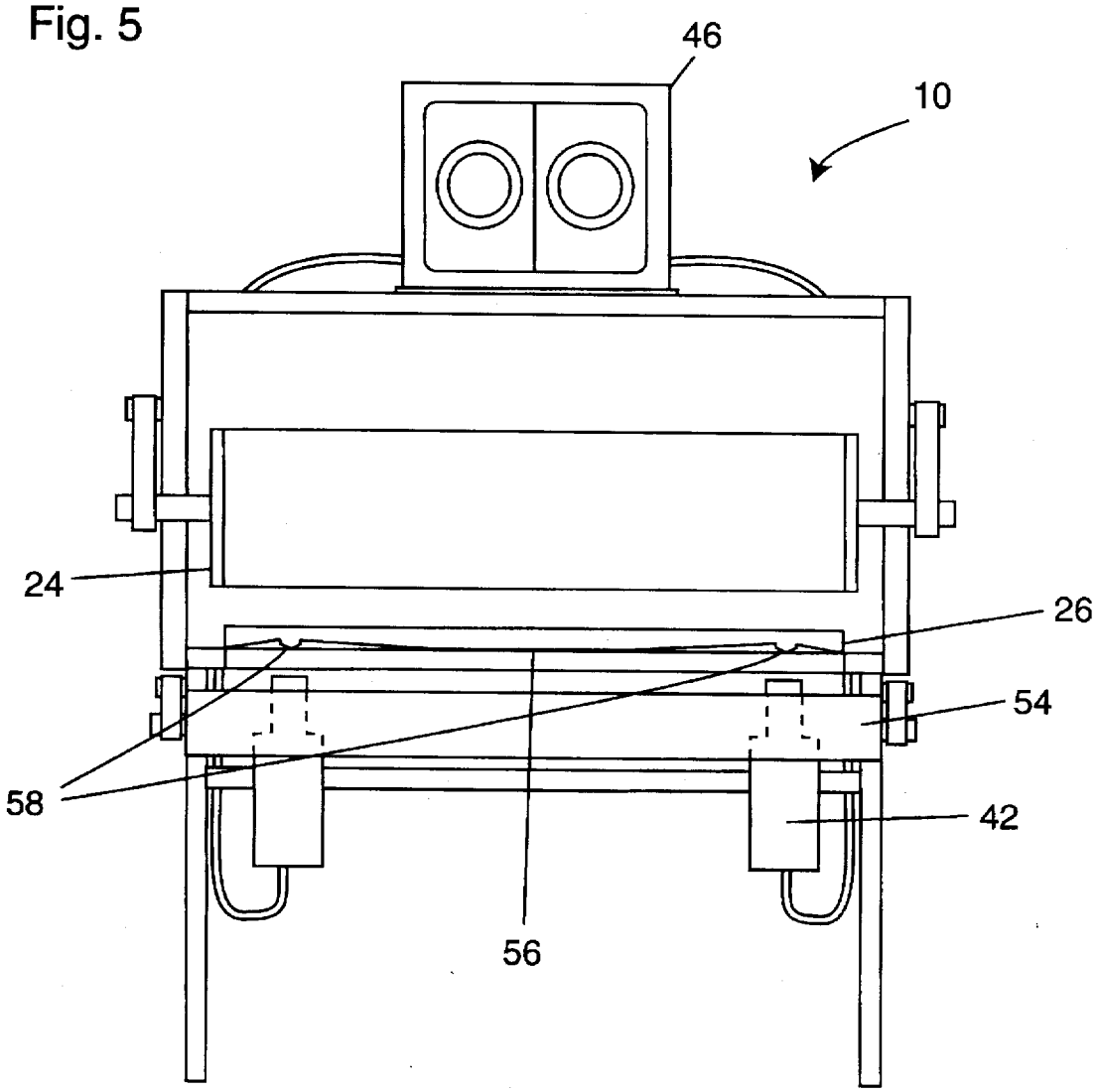
FIG. 5 is an end view of a printing plate mounting system of the present invention.
Figure 6:
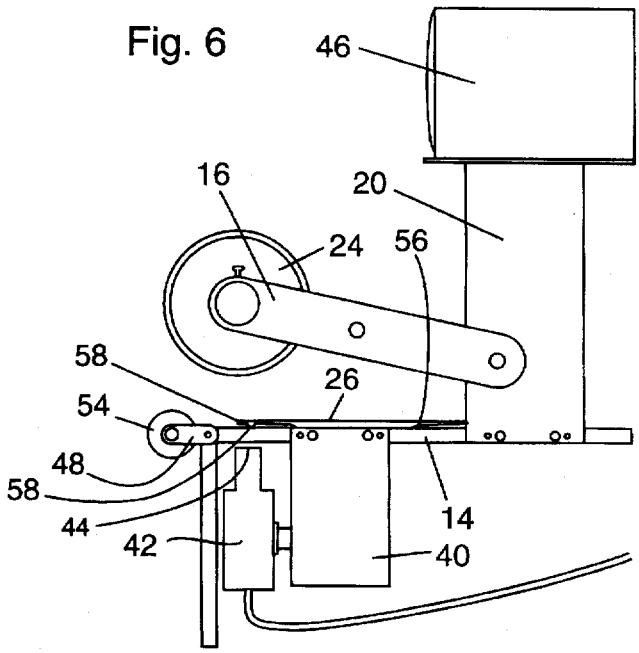
FIG. 6 is a side view showing a printing plate mounting system of the present invention having a flexographic printing plate thereon showing a step in the operation of the system.
Figure 7:
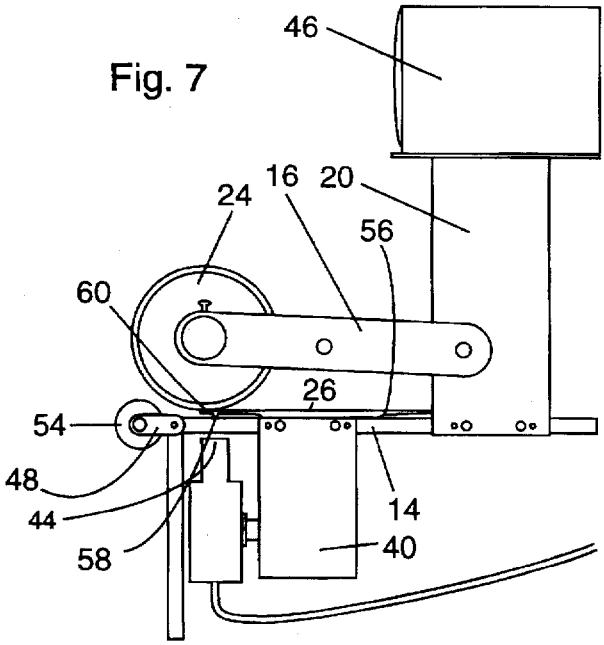
FIG. 7 is a side view showing a printing plate mounting system of the present invention having a flexographic printing plate thereon showing another step in the operation of the system.

In operation, the plate 26 is placed face down on the printing plate support surface 14 for mounting, as seen in FIG. 4. The microdots 58 are first positioned along the central axis 33 of the transparent plate 32 as seen in FIGS. 4 and 6. The cameras 42 are actuated along the track 40 to locate the microdots 58 substantially in the centering circles of the screen 46 and are then locked in position as depicted in FIGS. 3 and 5.

It is not uncommon that the plate cylinder 24 will vary up to several thousandths of an inch in diameter from one end to the other. Consequently, the printing plate 26 will have to be slightly canted to adjust for the variation in diameter size. This can be achieved by orienting the registration marks on opposite sides of the central axis 33, for example, and then adjusting the track 40 and cameras 42 to center the marks prior to fixing the cameras 42 for subsequent registration of other plates.

Figure 8:
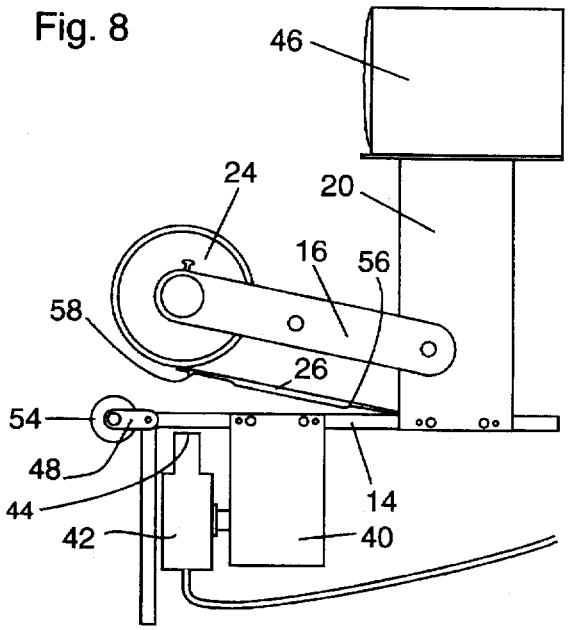
FIG. 8 is a side view showing a printing plate mounting system of the present invention having a flexographic printing plate thereon showing yet another step in the operation of the system.
Figure 9:
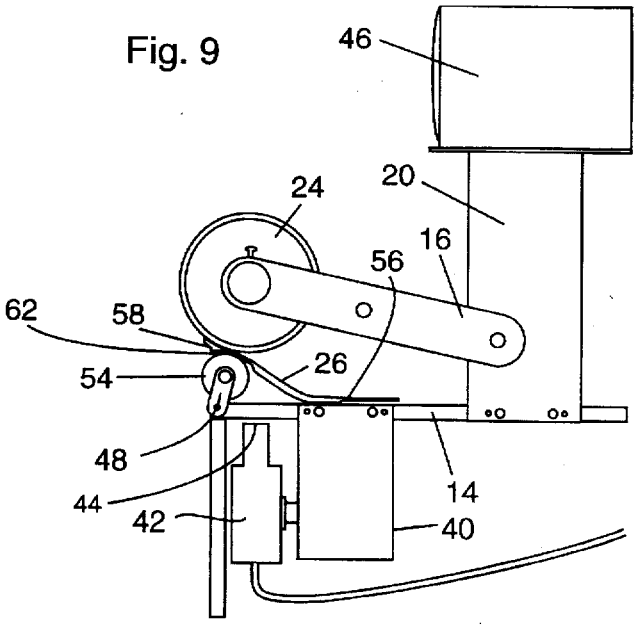
FIG. 9 is a side view showing a printing plate mounting system of the present invention having a flexographic printing plate thereon showing still another step in the operation of the system.
Figure 10:
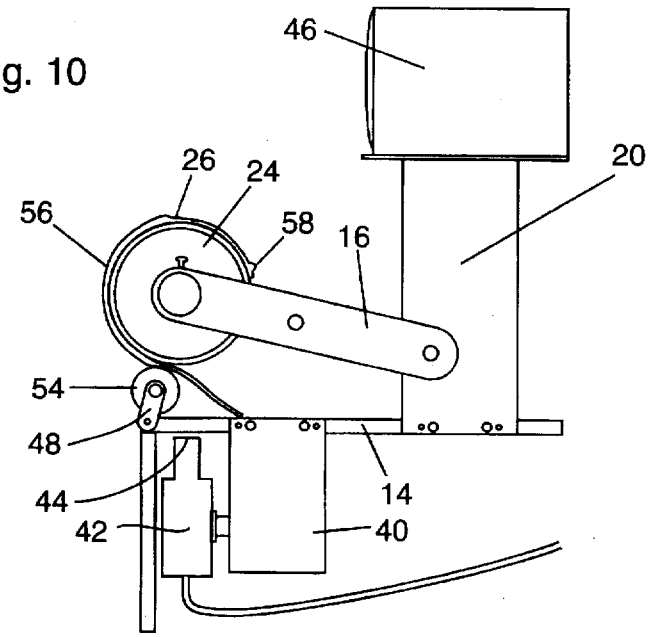
FIG. 10 is a side view showing the printing plate mounting system of the present invention having a flexographic printing plate thereon showing another step in the operation of the system.
Figure 11:
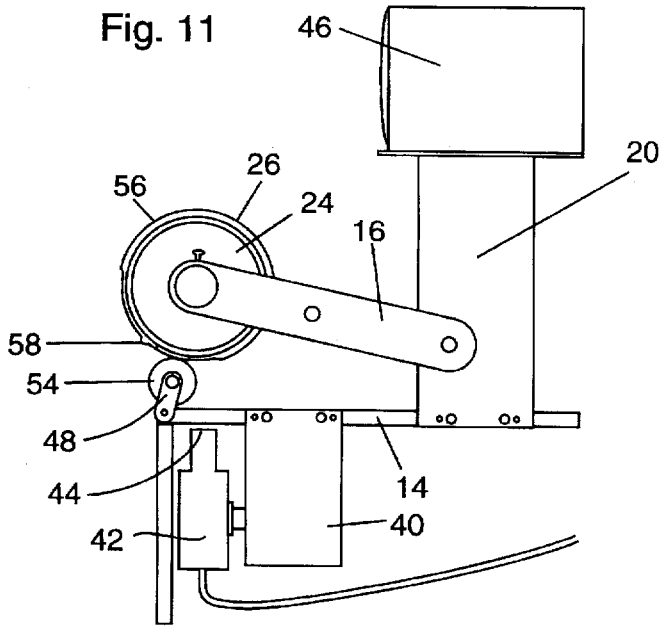
FIG. 11 is a side view showing the printing plate mounting system of the present invention having a flexographic printing plate thereon showing yet another step in the operation of the system.
Figure 12:
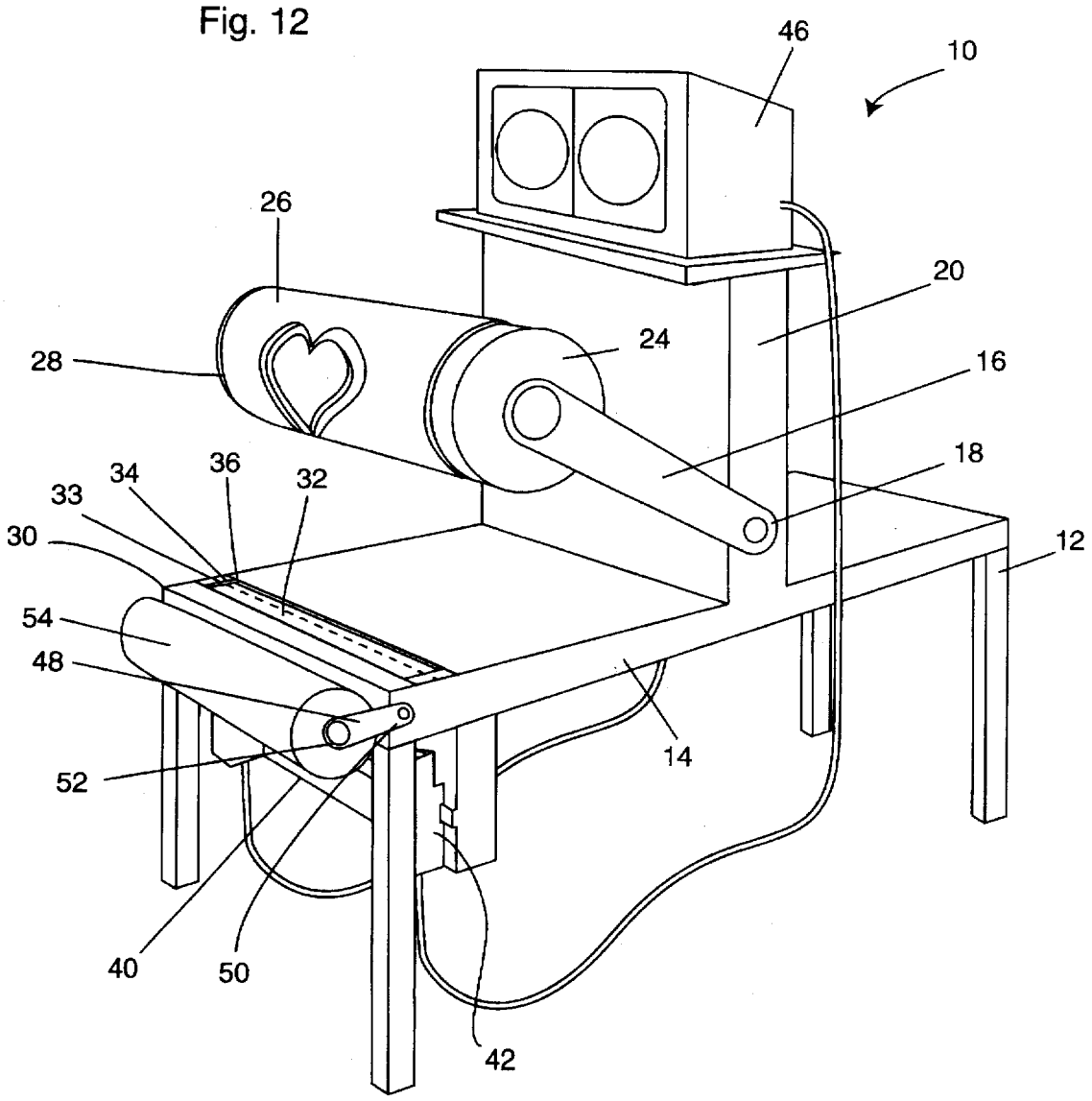
FIG. 12 is another perspective view showing the printing plate mounting system of the present invention.

The arms 16 are actuated to a point wherein the sticky back 28 of the plate cylinder 24 is brought into contact with a back surface 60 of the plate 16 along a uniform line. The arms 16 are then actuated in opposite direction such that the plate cylinder 24 is sufficiently disposed away from the printing plate support surface 14 with the printing plate 10 adhered thereto to permit the plate 26 to be rolled into position on the plate cylinder 24, as seen in FIG. 8. To aid in this regard, the arms 48 are actuated toward the plate cylinder 24 to a point such that the pressure roller 54 is positioned against a front surface 62 as seen in FIGS. 9–11. The plate 26 is then rolled onto the sticky back plate cylinder 24 in a uniform manner by virtue of the frictional nip between the plate cylinder 24 and pressure roller 54 when one of the plate cylinder 24 and the pressure roller 54 is rotated. The arms 48 are then actuated in an opposite direction to remove the pressure roller 54 away from the plate cylinder 24 as seen in FIG. 12. The plate cylinder 24 with the printing plate 26 thereon can then be removed from the arms 16 for use in a desired application.

Figure 13:
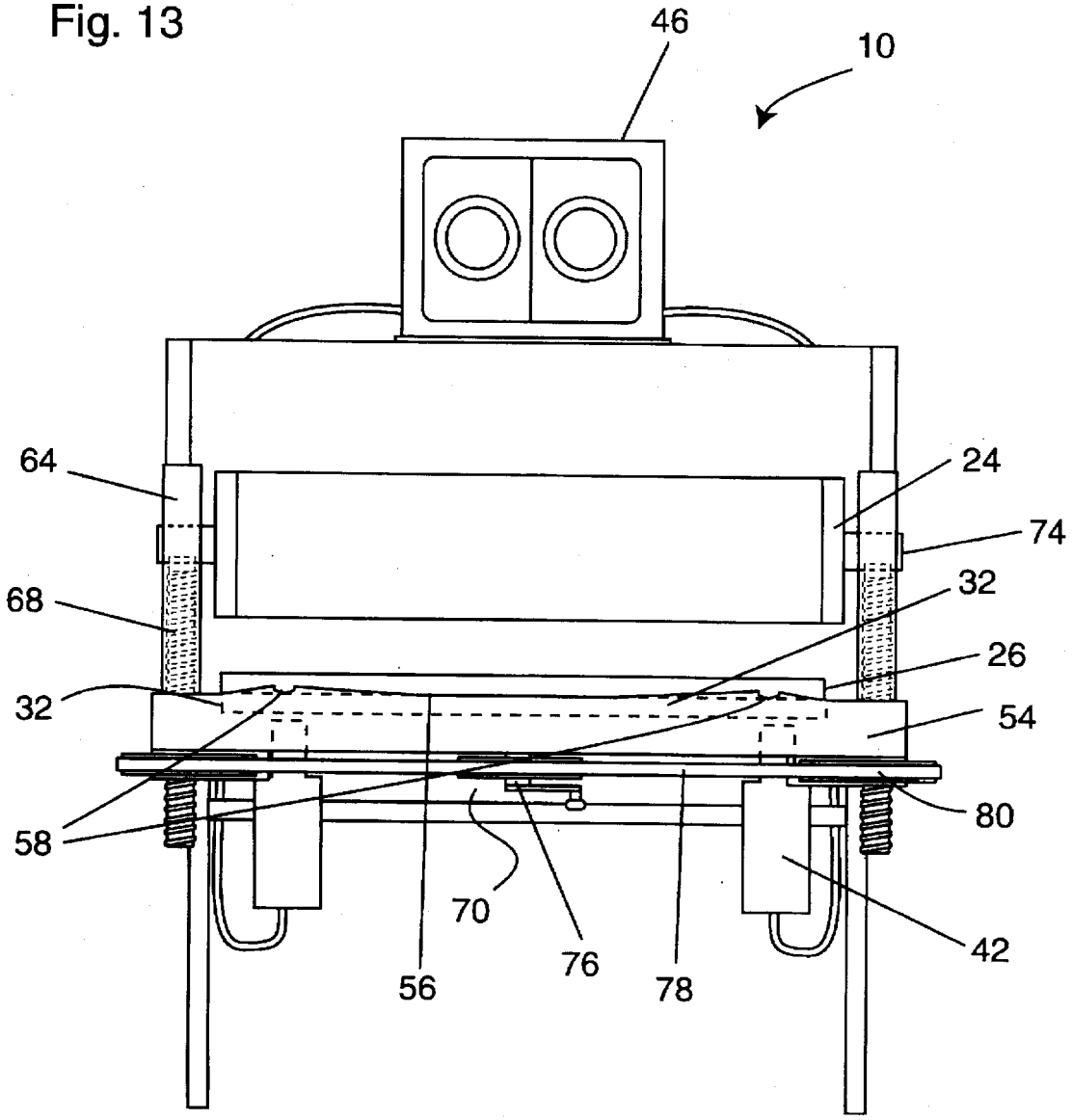
FIG. 13 is an end view of another embodiment of a mounting device for use in the present invention.
Figure 14:
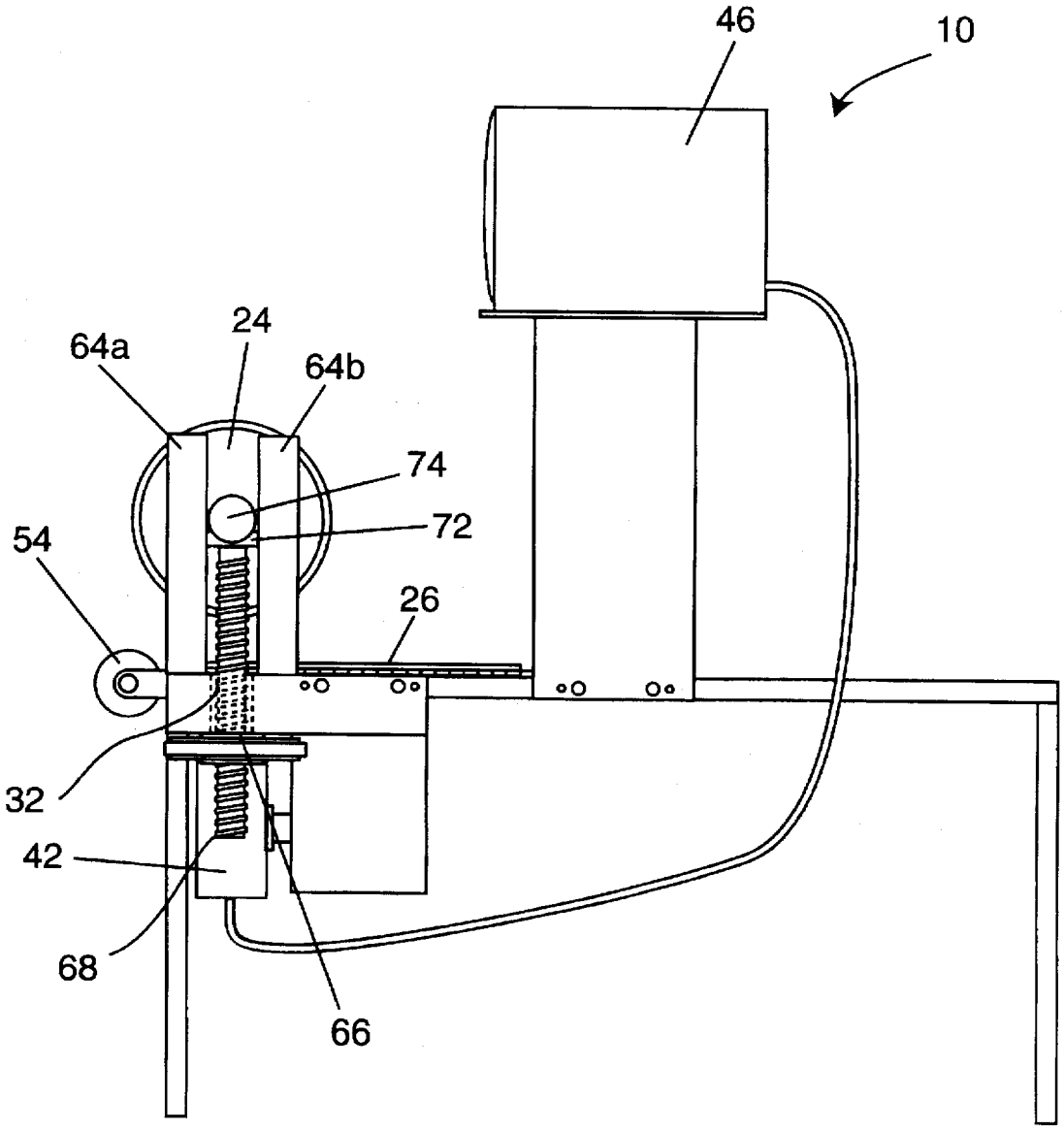
FIG. 14 is a side view of another embodiment of a mounting device for use in the present invention.

Alternatively, as seen in FIGS. 13–14, the mounting device 10 is employable for use in mounting varying size plate cylinders. The mounting device 10 in this embodiment differs in that it includes support members 64 fixedly connected in a predetermined alignment relationship to the support surface 14, bored surfaces 66, threaded shafts 68 and means 70 for reciprocating the threaded shafts 68. One of the shafts 68 extends through one of the bore surfaces 66 and has fixed to one end a bearing member 72 connected thereto which slidably fits between the support members 64. A plate cylinder 24 having a shaft 74 is disposed between the support members 64*a* and 64*b* such that the shaft 64 bears upon the bearing member 72. The shaft 74 is preferably of a diameter slightly less than the distance between support members 64*a* and 64*b* to keep the plate cylinder 24 in a predetermined alignment with respect to the transparent plate 32.

The reciprocating means 70 includes a crank 76 and operably connected arms 78 and threaded wheels 80. The wheels 80 are operably connected to the threaded shafts 68 such that when the crank 76 is turned, the wheels 80 rotate to cause the shafts 68 to uniformly move between the support members 64 thus moving the plate cylinder 24 toward or away from the printing plate support surface 14 depending upon the direction the crank 76 is turned. It is recognized that other mechanisms may be employed to accomplish this result, such as a hydraulic mechanism.

The mounting process for this embodiment is essentially the same as previously described, wherein a difference exists in how the plate cylinder 24 is brought into contact with the printing plate 26. It is believed this embodiment provides an additional feature of being able to easily mount in register plates of varying sizes onto complimentary sized plate cylinders by virtue the shaft 74 remaining uniformly positioned and centered over the central axis 33 regardless of the plate cylinder 24 size.

As previously discussed, some of the plate materials described above are limited in their size in which they can be formed. In other cases, it is desirous to prepare different strips of printed art work which can be ganged together for a run. In either case, the invention works in principle the same way.

By so providing the present invention, there has been created a novel and improved printing plate mounting system which substantially reduces human error in aligning and registering the flexographic printing plates onto a plate cylinder. The present invention has also substantially reduced the ease in which the flexographic printing plate mounting process is accomplished.

There will be many modifications and variations to the present invention which will be readily apparent to those skilled in the art and the embodiments set forth above are put forth by way of example for flexible printing plate mounting systems but will have application to other techniques, such as letter press, for example. Accordingly, such modifications and variations should be within the scope of the claims appended hereto.

What is claimed is:

1. A system for mounting a flexographic printing plate having a registration mark, including:

a printing plate support surface having a transparent portion formed therein;

a plate cylinder;

means operably connected to said plate cylinder for positioning said plate cylinder toward said printing plate support surface in a manner to establish a uniform contact line along one side of the printing plate when disposed on said printing plate support surface, a camera operably disposed adjacent another side of said transparent portion for taking a picture of the registration mark of the printing plate when said registration mark is positioned over one side of said transparent portion; and a monitor operably connected to said camera having means for viewing the registration mark and position thereof with respect to said camera.

2. The system of claim 1, which further includes a sticky back material disposed about said plate cylinder.

3. The system of claim 1, which further includes a grid formed on said printing plate support surface.

4. The system of claim 1, which further includes a pressure roller and means operably connected to said pressure roller for positioning said pressure roller toward said plate cylinder in a manner to dispose said pressure roller adjacent another side of the printing plate along said contact line such that the printing plate is fictionally disposed between said plate cylinder and said pressure roller and at least one of said plate cylinder and pressure roller is rotatable.

5. A method for mounting a flexographic printing plate which has a registration mark thereon comprises the steps of:

(a) orienting the printing plate onto a printing plate support surface having a transparent portion in the surface thereof such that said registration mark is positioned over one side of said transparent portion;

(b) orienting camera means adjacent another side of said transparent portion for viewing said registration mark when positioned over said transparent portion;

(c) manipulating at least one of said printing plate and camera means such that said registration mark is substantially centered within a view afforded said camera means;

(d) contacting a plate cylinder to a first surface of said printing plate along a uniform contact line; and (e) adheringly applying said printing plate to said plate cylinder.

6. The method of claim 5, which further includes before said step (e), steps of (f) displacing said plate cylinder and said printing plate from said printing plate support surface in a manner which maintains said printing plate in relative fixed position with respect to said plate cylinder and (g) contacting a rotatable pressure roller to a second surface of the printing plate along said contact line such that said printing plate is frictionally disposed between said plate cylinder and said pressure roller.

7. The method of claim 5, wherein said step (d) is further defined to be contacting a sticky back plate cylinder to said printing plate and which further includes the step (f) to be performed prior to said step (e), wherein said step (f) includes positioning said plate cylinder away from said printing plate support surface with said printing plate adhered thereto along said contact line and (g) applying pressure to said printing plate in a manner to cause a remainder of said printing plate to adhere to said cylinder.

8. The method of claim 6, which further includes before said step (e), the step of (f) contacting a rotatable pressure roller to a second surface of the printing plate along said contact line such that said printing plate is frictionally disposed between said plate cylinder and said pressure roller.

9. A printing plate mounting system for mounting a flexographic printing plate having a registration mark thereon, which comprises:

a rotatable plate cylinder;

a printing plate support surface;

means operably connected to said plate cylinder for positioning said cylinder toward one side of the printing plate when disposed on said printing plate support surface and in a manner to establish a uniform contact line on the printing plate;

a pressure roller; and means operably connected to said pressure roller for positioning said pressure roller toward another side of said printing plate along the uniform contact line.

10. The printing plate mounting system of claim 9, which further includes a sticky back material disposed about said plate cylinder.

11. The printing plate mounting system of claim 9, which further includes a grid formed on said printing plate support surface.

12. The printing plate mounting system of claim 9, wherein said printing plate support surface further includes a transparent portion such that the printing plate can be disposed on one side thereof and to permit the registration mark to be placed thereon and further includes a camera operably disposed adjacent another side of said transparent portion for taking a picture of the registration mark of the printing plate when positioned over the one side of said transparent portion, and a monitor operably connected to said camera having means for viewing the registration mark and position thereof with respect to said camera.

* * * * *